US005918298A

United States Patent [19]

Everly

[11] Patent Number: 5,918,298

[45] Date of Patent: Jun. 29, 1999

[54] TONE CONTROL FOR STRINGED INSTRUMENTS

[76] Inventor: Phillip Everly, 10414 Camarillo St., North Hollywood, Calif. 91602

[21] Appl. No.: 08/885,015

[22] Filed: Jun. 30, 1997

[51] Int. Cl.[6] ..... G10D 3/00

[52] U.S. Cl. ..... 84/291; 84/294

[58] Field of Search ..... 84/291, 294

[56] References Cited

U.S. PATENT DOCUMENTS 3,233,495 2/1966 Bernardi ..... 84/294

*Primary Examiner*—William M. Shoop, Jr.
*Assistant Examiner*—Shih-yung Hsieh
*Attorney, Agent, or Firm*—Julius Rubinstein

[57] ABSTRACT

In order to adjust the tone of a machine made stringed instrument, so the notes of the machine made stringed instrument are balanced, the sounding box of an initial test instrument is constructed. Then the surface of the sounding box is tested to determine regions of excessive resonance. Next, to control excessive resonance, resonating regions of the sounding box are covered with one or more layers of a wood based sheet material until the overall tone of the test instrument is satisfactory. Then machine made duplicates of the sounding box of the instrument are made. The location of the wood based sheet material having been determined, the new instruments are provided with the same material at the same locations, so the resulting instruments all have the same tone.

7 Claims, 1 Drawing Sheet

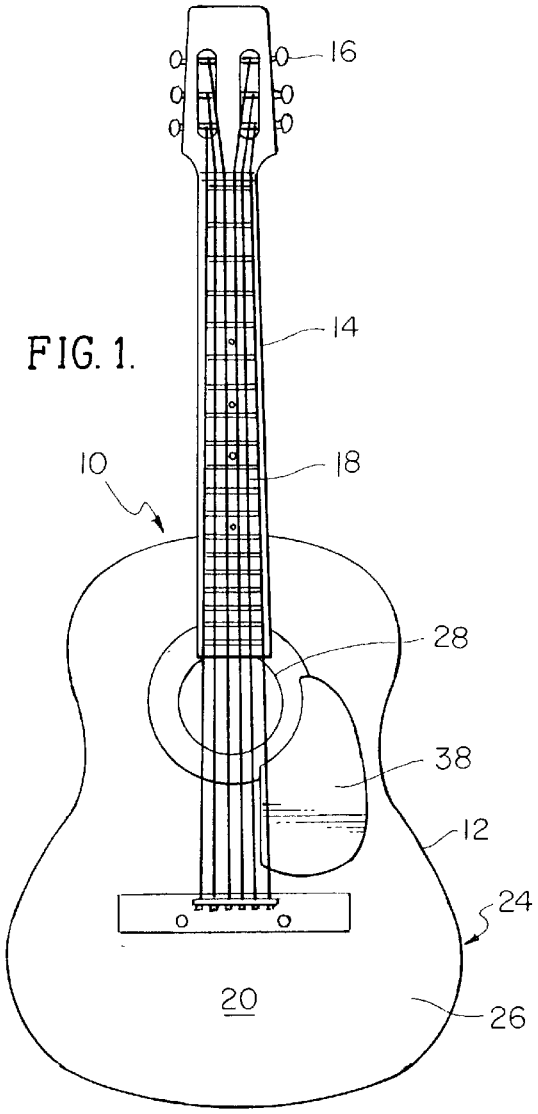
FIG. 1.
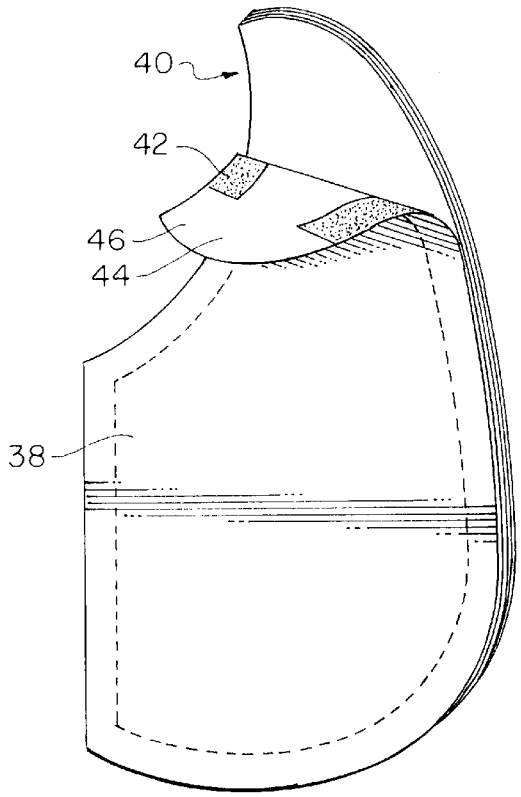
FIG. 4.
FIG. 2.
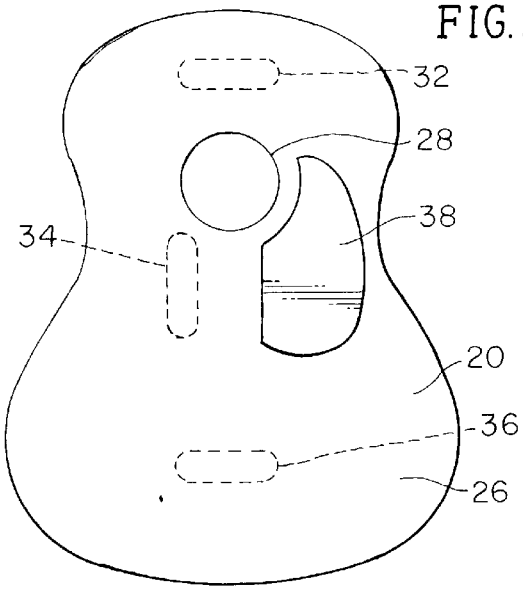
FIG. 3.
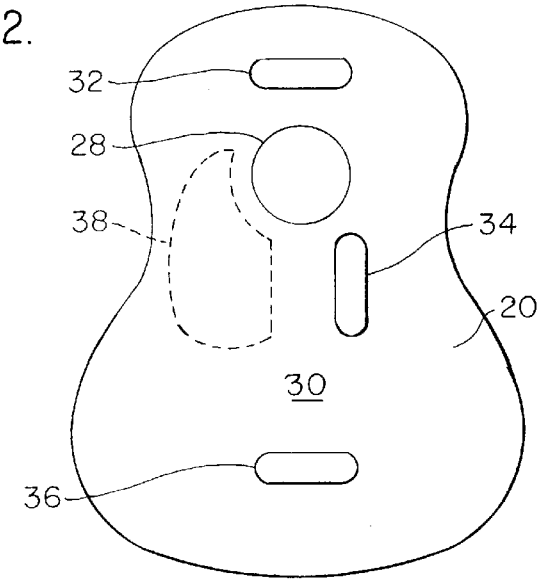

TONE CONTROL FOR STRINGED INSTRUMENTS

This invention relates to a stringed instrument, and more particularly to the sounding box of a stringed instrument having means for adjusting its tone.

FEDERALLY SPONSORED RESEARCH

No part of this patent application was developed with the aid of any federally sponsored research and development.

DESCRIPTION OF PRIOR ART

The violin and the guitar family of stringed instruments comprise a set of strings mounted on a wooden sounding box containing an almost closed air space. When the strings are set into vibration, the energy of the strings is communicated to the wooden box. This sets up corresponding amplified vibrations in the sounding box that produce sound waves that reach the ear. These sound vibrations consist of a fundamental tone and a number of higher pitched partial tones. The quality of the tone of a stringed instrument or timbre is determined by the number of partial tones and their relative loudness. These vary from one instrument to another of the same kind, which is why the quality and value of instruments of the same kind differ.

There is no simple way to design these instruments so that the tone of the finished instrument can be determined before construction, because of the many variables involved. For example the kind of wood used to form the instrument, its moisture content, its age, its thickness, and its flexibility are just a few of the variables that affect the tone of the instrument. Moreover, the thickness of the top plate and back plate of the sounding box may have to be varied to adjust the flexibility of different portions of the sounding box. This is to cause the resonance of the sounding box to coincide with the frequency of a stringed harmonic. Unless care is taken, resonance will cause the sound of some notes of the instrument to be substantially amplified, thereby affecting the overall tonal balance.

In order to produce a master grade instrument an experienced craftsman has to remove the top and bottom plate one or more times and the wood scraped, to thin out various parts of these plates, and then the instrument has to be reassembled and tested until the proper tonal balance is achieved. This is time consuming and expensive.

BRIEF SUMMARY OF THE INVENTION

For reasons of economy, it would be desirable to mass produce machine made stringed instruments having a sounding box which can be adjusted so all the instruments have the same high quality tone. To do this attention must given to the behavior of sound as it passes through different mediums. For example, when sound passes from wood to plastic, the sound is substantially attenuated. This is particularly true of devices which are formed from plastic and are permanently secured to the sounding box of a guitar. When placed on the top plate of the guitar their function is to prevent the instrument from being scratched when played by the musician. This is important when the instrument is played before a live audience where scratches could be noticed.

It was not realized that the attenuation caused by this plastic piece also had an adverse affect on the tone of the instrument because it prevented uniform vibration of the sounding box. This in turn prevented the tone of an aging well used instrument from improving. The reason is that when the instrument is played for a long time without this plastic piece, the uniform vibration of the sounding box causes the wood of the sounding box to become more flexible and responsive to the vibration of the strings thereby improving its tone.

If however, the sound passes from the wood of the sounding box to a sheet of wood based material secured to a surface of the sounding box, such as shelf paper, or any other material having similar sound transmission characteristics, the attenuation is too small to affect the tone of the instrument. As a result, as the instrument ages, its tone will improve.

Sometimes, however, increased attenuation of selected parts of the sounding box is necessary because the sounding box has scores of resonant notes. This means that some notes of the stringed instrument will sound louder than other notes no matter what the musician does. To prevent this, advantage can be taken of the fact that the attenuation of each sheet of a wood based sheet material is small. Consequently one or more sheets can be stacked on top of each other in layers, over parts of the sounding box where resonance causes some notes of the instrument to be amplified too much. In this way, the attenuation at these parts can be gradually increased, as needed, to bring the overall tone of the instrument into balance.

What is needed therefore and comprises an important object of this invention is to provide machine made stringed instruments adjusted to have the same tone.

Another important object of this invention is to optimize the tone of the sounding box of a stringed instrument.

Yet another object of this invention is to provide a way to vary the tone of the sounding box of a stringed instrument.

Still another object of this invention is to provide combined means for modifying the tone of the sounding box of a stringed instrument and for protecting its surface from scratches.

These and other objects of this invention will become more apparent when better understood in the light of the accompanying drawings wherein:

FIG. 1 is a plan view of a guitar constructed according to the principles of this invention.

FIG. 2 is a plan view of the upper surface of the top plate of the sounding box of a guitar showing an example of attenuation control devices placed over the sounding box at regions of excessive resonance.

FIG. 3 is a plan view of the bottom surface of the top plate shown in FIG. 2.

A FIG. 4 is a perspective view of a pad of sheet material used for controlling the tone of guitar.

Referring now to FIG. 1 of the drawing a typical guitar 10 comprises a sounding box 12, a neck 14, and tuning keys 16. Strings 18 are stretched over the sounding box in a manner well known in the art.

The sounding box 12, usually made from wood, comprises a top plate 20, see FIG. 2, a bottom plate (not shown but generally similar in shape to the top plate), and connecting side walls 24. The upper surface 26 of the top plate 20 has a sound hole 28 extending there through. In use, the strings are tuned to the desired frequency. Then when the strings, in a guitar, for example, are plucked or picked, the sounding box amplifies the vibrations of the strings.

As stated above, the tone of a high quality stringed instrument was previously controlled by taking the instrument apart, again and again to scrape out the wood of the sounding where required, and then reassembling the instrument each time until the proper tone is achieved. But scraping the instrument requires the effort of a very skilled craftsman.

To eliminate this difficulty, the low attenuation characteristics of a wood based sheet material provide a way to control the tone of a machine made sounding box. If the thickness of the sounding box of a machine made instrument is designed so it is a little thinner than usual, then the need for scrapping the instrument is eliminated and those parts of sounding box which resonates too strongly can be covered with one or more sheets of the wood based sheet material, or other material having the same characteristics to achieve the proper tonal balance. In this way the resonance at certain locations of the sounding box can be controlled and the tone of the instrument can be improved.

To determine the regions of the sounding box where the resonance to too loud, a loudness meter such as made by General Radio Company, or its equivalent, is moved over the sounding box at semi-tone intervals over the entire range of notes. Once these regions of excessive resonance are located, the sound at these regions can be attenuated by securing the required number of layers of the wood based sheet material to these regions.

To do this, a pad 40 of wood based sheet material is shown in FIG. 4. Each sheet 31 of the material is provided with an adhesive 42 on one surface. The adhesive can cover the entire back of each sheet or only the periphery. A small portion 44 of the periphery of each sheet does not have an adhesive so the sheets can be easily separated from the pad. As described herein, the adhesive 42 permits the sheets to be securely stacked on top of each other. Each portion 44 has an adjacent perforated tear line 46 which is used to separate portion 44 from the rest of the sheet so that the adhesive on the remaining portion of the periphery of the sheet can stick to the surface of the sounding box or on other sheets of material. Once the attenuation necessary for a region of the sounding box is determined, the number of sheets of the wood based sheet material required to provide this attenuation is removed from the pad, and the sheets are then shaped to fit on the sounding box as required.

For mass production purposes, once the craftsman positions the sheets of material on the sounding box of an initial standard machine made instrument until the desired tone is achieved, it would be simple to duplicate the pattern of the sheet material on the outside or inside of each machine made wooden sounding box to achieve the same tone. This provides an inexpensive way to mass produce high quality musical instruments.

By way of example, FIGS. 2 and 3 layers of wood based sheet material 32,34,36 and 38, or the like are secured where needed to control resonance, to the upper and lower surface 26 and 30 of the top plate 20. In addition, other layers of material may be secured to the bottom plate and connecting side walls 24 to achieve tonal balance.

If the stringed instrument is a guitar, it is noted that the wood based sheet 38 shown in FIG. 1 has a double function in that it attenuates the top plate and at the same time it protects the appearance of the upper surface 26 from scratches caused when a plectrum used to strike the strings also strikes the upper surface 26 of the top plate. This maintains the appearance of the instrument when played before a live audience. This sheet material could be made so it duplicates the natural color of the wood. Sheet 38 is secured to the surface of the instrument by adhesive 42 so it can be easily removed and replaced to change the appearance of the instrument.

Although the principles of this invention are described in connection with a guitar, the invention can be practiced with all kinds of stringed instruments which have vibrating strings mounted over a sounding box.

Having described the invention, what I claim as new is:

1. A guitar comprising a sounding box having an upper plate and a lower plate, said upper plate having an upper surface and a lower surface, strings mounted over the upper surface of the upper plate, a sheet material having a low attenuation to sound adhere to a surface of the sounding box at regions of resonance to attenuate the intensity of the resonant sound at those regions.

2. The guitar described in claim 1 wherein the sounding box of said instrument is made of wood, said sheet material being sheets of wood based material, each sheet having an adhesive on at least one surface whereby one or more sheets of said sheet material can be adhere to the sounding box to gradually increase the attenuation of the sound to the extent required to control resonance at those regions.

3. The instrument described in claim 1 with at least one sheet of said sheet material adhered to the upper surface of the upper plate of the sounding box of said guitar and positioned to protect the appearance of said guitar from scratches caused by the plectrum when the instrument is being played and to attenuate the sounding box as needed.

4. A method of standardizing the tone of machine made stringed instruments having a sounding box, comprising the steps of designing a full size model of the instrument so it can be duplicated by machines, using a device on the sounding box to determine regions of excessive resonance, covering those regions with one or more sheets of a material each of which has low sound attenuation until the desired tonal balance is achieved, then duplicating the pattern of the sheets of material adhered to the sounding boxes of other machine made instruments so that all the machine made instruments have the same tonal balance.

5. The method of standardizing the tone of a machine made stringed instrument having a wooden sounding box, comprising the steps of designing a full size model of the sounding box of the instrument so it can be duplicated by machines, using a device on the sounding box to determine regions of excessive resonance, covering these regions with one or more sheets of a wood based sheet material until the desired tonal balance is achieved, then duplicating the pattern of sheet material adhered to the sounding boxes of other machine made instruments so that all the instruments have the same tonal balance.

6. A device for controlling the tone of a guitar, comprising a stack of sheets of a wood based sheet material, one surface of each sheet having an adhesive covering at least a substantial portion of the periphery of the sheet material so that the said portion of the periphery of the sheet material can adhere to a surface of a sounding box of a stringed instrument or on other sheets of said material, a small portion of the periphery of each sheet having no adhesive whereby the sheets of material can be separated from each other.

7. The device described in claim 6 including means adjacent said small portion of the periphery of the sheet material for separating said portion of the periphery from the remainder of the sheet.

* * * * *